US010060660B2

(12) United States Patent
Khoo

(10) Patent No.: US 10,060,660 B2
(45) Date of Patent: Aug. 28, 2018

(54) ATOMIZING DEVICE FOR IMPROVING THE EFFICIENCY OF A HEAT EXCHANGE SYSTEM

(71) Applicant: Articmaster Inc., Las Vegas, NV (US)

(72) Inventor: Cass Khoo, Alameda, CA (US)

( * ) Notice: Subject to any disclaimer, the term of this patent is extended or adjusted under 35 U.S.C. 154(b) by 287 days.

(21) Appl. No.: 14/803,456

(22) Filed: Jul. 20, 2015

(65) Prior Publication Data

US 2016/0195309 A1 Jul. 7, 2016

Related U.S. Application Data

(60) Provisional application No. 62/099,735, filed on Jan. 5, 2015.

(51) Int. Cl.
*F25B 40/02* (2006.01)
*F25B 1/00* (2006.01)

(52) U.S. Cl.
CPC ..... *F25B 40/02* (2013.01); *F25B 1/00* (2013.01); *F25B 2400/16* (2013.01)

(58) Field of Classification Search
CPC ..... F16L 23/0286; F16L 55/02718; F16L 55/02727; F16L 55/02745; F16L 55/0331; F16L 55/0332; F16L 55/02763; F25B 40/02; F25B 41/06; F25B 41/00; F25B 2339/0441; F25B 2500/12; F25B 43/003; F25B 40/04; F25B 2500/13; F25B 43/00; F25B 29/028; F25B 14/06; F28F 13/003; F28F 9/027; F28F 9/0282; F28F 9/026; F28F 9/24; F28F 13/12; F28F 13/06; B01F 5/0065; B01F 5/0057; B01F 5/0618; B01F 2005/0639; B01F 2005/0637
USPC ..... 138/40–44; 428/118, 117; 62/511
See application file for complete search history.

(56) References Cited

U.S. PATENT DOCUMENTS 5,059,226 A * 10/1991 Schneider ..... F25B 39/028 55/459.1
5,727,398 A * 3/1998 Phillippe ..... F25B 41/06 138/40
5,875,651 A * 3/1999 Hill ..... F25B 41/06 138/44

* cited by examiner

*Primary Examiner* — Cassey D Bauer
(74) *Attorney, Agent, or Firm* — Sumana Prabhu

(57) ABSTRACT

A method and apparatus to improve the efficiency of a heat exchange system comprising a compressor, condenser, expansion valve, an evaporator and an expansion valve are provided. The apparatus is positioned between the expansion valve and the evaporator and comprises an atomizing disc, an outer connector pipe and two inner pipes inside the connector pipe in contact with the disc. The disc is provided with vertical blades that are angled to provide the turbulence necessary to create a low pressure at the back of the disc. The low pressure thus created vaporizes the partially vaporized incoming refrigerant from the expansion valve and thereby improves the efficiency of the refrigeration system.

10 Claims, 7 Drawing Sheets

ATOMIZING DEVICE FOR IMPROVING THE EFFICIENCY OF A HEAT EXCHANGE SYSTEM

CROSS-REFERENCE TO RELATED APPLICATION

This patent application claims the priority benefit under 35 U.S.C. § 119(e) of U.S. Provisional Application No. 62/099,735 filed on Jan. 5, 2015, the contents of which are herein incorporated by reference.

FIELD OF THE INVENTION

The invention relates generally to heat exchange systems and particularly to refrigeration and air conditioning devices. More specifically an atomizing device is disclosed which enhances the efficiency of the refrigeration system and reduces energy consumption by the system.

BACKGROUND OF THE INVENTION

A typical refrigeration system has four basis components: a compressor, a condenser, an evaporator, a circulating refrigerant an expansion valve and the necessary plumbing to securely connect the components. These components are essentially the same regardless of the size of the system. The refrigerant, to begin with, is in a gaseous state and compressed in a compressor so as to produce high pressures and temperatures. When the gas temperature/pressure in the compressor is greater than that of the condenser, gas will move from the compressor to the condenser. In the condenser, the refrigerant vapor is liquified and then transported to the expansion valve where the refrigerant runs into a constriction that does not allow it to pass through easily. As a result, the pressure and hence the temperature of the liquid refrigerant coming out of the valve and flowing into the evaporator drops considerably. In the evaporator coil, heat exchange with the warmer environment takes place and the refrigerant boils and changes phase from liquid to vapor. After evaporating into its gaseous form, the gaseous refrigerant is moved to the compressor to repeat the cycle.

In most cases, refrigerant supplied to the evaporator exists in both liquid and vapor form with only a small amount of vapor. To begin with, the refrigerant that enters the the expansion valve from the condenser is generally in 100% liquid form at a high temperature of approximately 105 deg C. (corresponding to a pressure of 278 psig). Once it passes through the expansion valve, the pressure and temperature drop drastically (to about 41 deg F.). The sudden drop in temperature causes the boiling point or saturation temperature of the liquid refrigerant to drop. Hence some of the liquid boils off and flashes into vapor (flash gas). The refrigerant entering the evaporator is therefore partially in liquid form with a smaller vapor fraction. The liquid in the evaporator is in an adiabatic state and therefore cannot absorb or reject heat. Only when liquid changes to the vapor state, the refrigerant can absorb heat from the warmer environment that needs to be cooled.

For efficient heat transfer through the evaporator coil, it would be beneficial to utilize as much of the evaporator coil area as possible. But the inefficient flow rate through the evaporator leads to inefficient cooling and build-up of frost or ice especially in the initial lower portion of the coil, leading to poor heat conduction through the evaporator coil and inefficient cooling.

The present invention overcomes the foregoing problems by providing an apparatus designed to improve the efficiency of a heat exchange system wherein the refrigerant is sufficiently vaporized before entering the evaporator coils so that the refrigeration mixture has higher vapor content than a normal refrigeration system.

SUMMARY OF THE INVENTION

In one aspect of the invention, a method and apparatus for enhancing the efficiency of a heat exchange system having a compressor, condenser, evaporator, an expansion valve and a circulating refrigerant is herewith provided. The apparatus is positioned in the heat exchange system between the expansion valve and the evaporator. The apparatus includes a tubular device and a means associated with the device for atomizing (or vaporizing) the refrigerant flowing into the device from the expansion valve. The tubular device includes an outer pipe (referred to henceforth as a 'connector pipe') having a first open end and a second open end, with the atomizing means positioned inside said outer pipe. The tubular device further includes a first inner pipe inserted through the first open end of the outer pipe and a second inner pipe inserted through the second open end of the outer pipe. The first inner pipe and the second inner pipe are in contact with the atomizing means and hold it firmly in place. Preferably, the atomizing means is a disc with at least two blades wherein the two blades are at an angle to the disc, In another aspect of the invention, a method of fabricating an efficiency-enhancing apparatus positioned between the expansion valve and evaporator of a heat exchange system is provided. The method involves providing an outer pipe having a first open end and a second open end, positioning an atomizing means within said outer pipe, inserting a first inner pipe through the first open end of said outer pipe; and inserting a second inner pipe through the second open end of said outer pipe wherein the first and second inner pipes are in contact with the atomizing means.

Another aspect of the invention is a heat exchange system with improved efficiency having a compressor, condenser, evaporator, an expansion valve, a circulating refrigerant and an atomizing apparatus positioned between the expansion valve and the evaporator. The apparatus includes a tubular device and a means associated the device for atomizing the refrigerant. According to an embodiment of the invention, the tubular device includes a outer pipe having a first open end and a second open end, with the atomizing means positioned inside said outer pipe. The tubular device further includes a first inner pipe inserted through the first open end of the outer pipe and a second inner pipe inserted through the second open end of the outer pipe. The first inner pipe and the second inner pipe are in contact with the atomizer and hold it firmly in place. In one embodiment, the atomizing means is a disc with at least two blades wherein the two blades are at an angle to the disc.

In yet another aspect of the invention, a heat exchange system with improved efficiency having a compressor, condenser, evaporator, an expansion valve and a circulating refrigerant is provided, said system comprising: a tubular device positioned between the expansion valve and the evaporator, a means associated with said device for atomizing the refrigerant forming into the device; and a sub cooling device positioned between the condenser and the expansion valve.

According to an embodiment of the invention, the sub cooling device comprises a vessel which stores a portion of the circulating liquid refrigerant from the condenser and comprises a refrigerant entrance and a refrigerant exit, a first means for creating turbulence at the refrigerant entrance, a second means for creating turbulence at the refrigerant exit and a bypass path from the refrigerant entrance to sub-cool a portion of the liquid refrigerant entering the vessel. The refrigerant bypass path comprises a bypass tube extending into the center of the vessel. The bypass tube terminates in at least one bypass exit port.

Preferably, the first means for creating turbulence comprises a disk located proximate said refrigerant entrance, wherein the disk permits the passage of entering refrigerant into the bottom of the vessel; and wherein the second means for creating turbulence comprises a disk located proximate the refrigerant exit, the disk permitting the passage of exiting refrigerant. According to an embodiment of the invention, at least one fixed angle blade is formed in the disk, wherein the blade adds turbulence to the exiting refrigerant. Preferably, three fixed angle blades are formed in the disc.

In yet another aspect of the invention, a heat exchange system with improved efficiency having a compressor, condenser, evaporator, an expansion valve and a circulating refrigerant is provided, said system comprising; a tubular device positioned between the expansion valve and the evaporator; a means for atomizing said refrigerant flowing into the apparatus from the expansion valve; and an auxiliary passive condenser positioned between the condenser and the evaporator.

According to an embodiment of the invention, the auxiliary passive condenser comprises a chamber having a refrigerant entry port and a refrigerant exit port and a down tube passing through the center of said chamber and through the exit port wherein the down tube includes holes to permit the passage of refrigerant from the chamber into the down tube.

Preferably the down tube comprises at least three holes. Further, the down tube comprises a top inlet port and a bottom outlet port wherein the ratio of the diameter of the inlet port to the outlet port is greater than 1. The top inlet port is sealed with an expansion screen wherein said expansion screen is a mesh comprising copper, aluminum or a copper-based alloy.

Another aspect of the invention is a method of improving the efficiency of a heat exchange system comprising a compressor, condenser, an expansion valve, evaporator and a circulating refrigerant, said method comprising the steps of compressing a refrigerant in said compressor, passing said refrigerant through a condenser, allowing the refrigerant exiting said condenser to flow through said expansion valve and into a tubular device wherein said device comprises a means for atomizing said refrigerant flowing into the apparatus from the expansion valve, In one embodiment, said tubular device comprises an outer pipe having a first open end and a second open end, an atomizing means positioned inside said outer pipe, a first inner pipe passing through the first open end of said outer pipe and a second inner pipe passing through the second open end of said outer pipe wherein the first inner pipe and the second inner pipe are in contact with the atomizing means.

In one embodiment, the atomizing means comprises a disc.

Preferably said disc comprises at least two blades wherein said at least two blades are at an angle to the disc.

Other novel features which are characteristic of the invention, as to organization and method of operation, together with further objects and advantages thereof will be better understood from the :following description considered in connection with the accompanying drawings, in which preferred embodiments of the invention are illustrated by way of example. It is to be expressly understood, however, that the drawings are for illustration and description only and are not intended as a definition of the limits of the invention. The various features of novelty which characterize the invention are pointed out with particularity in the claims annexed to and forming part of this disclosure. The invention resides not in any one of these features taken alone, but rather in the particular combination of all of its structures for the functions specified.

DETAILED DESCRIPTION OF THE INVENTION

Figure 1:
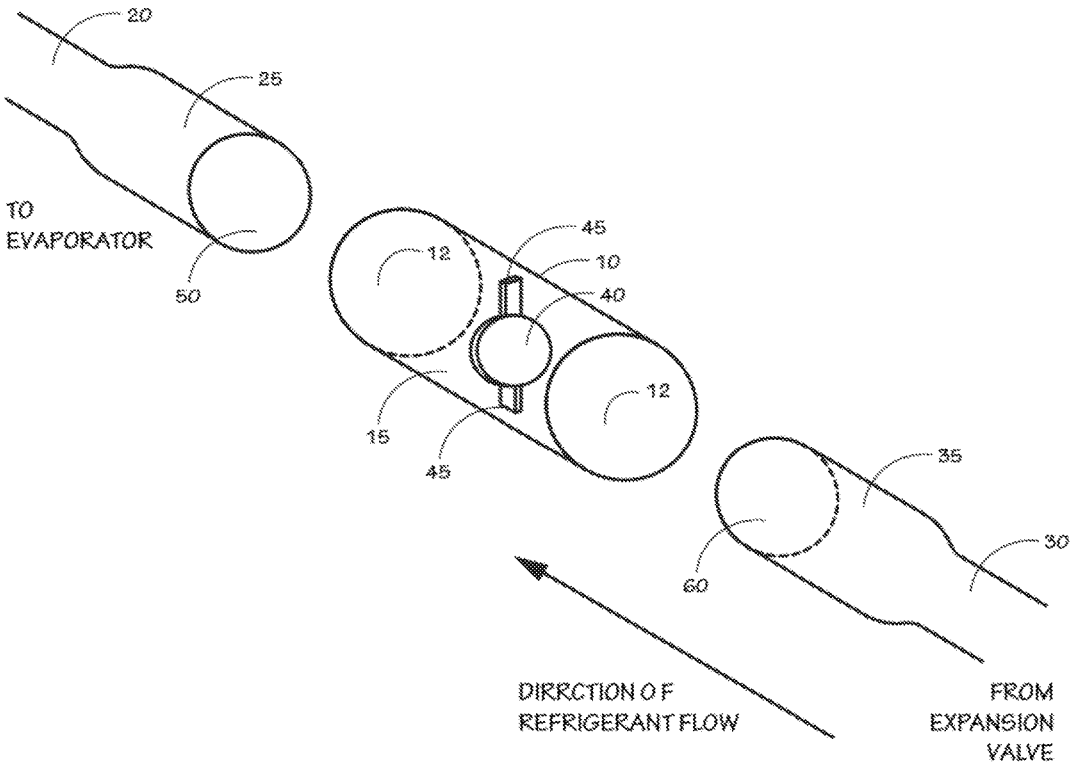
FIG. 1 shows the atomizing apparatus in accordance with an embodiment of the invention.

By way of introduction to the environment in which the inventive system operates, the following is a brief description of the functioning of a traditional refrigeration system.

Various devices relying on standard refrigerant recycling technologies have been available for many years, such as refrigeration and heat pump devices, having both cooling and heating capabilities. Within the limits of each associated design specification, heat pump devices enable a user to cool or heat a selected environment or with a refrigeration unit to cool a desired location. For these heating and cooling duties, in general, gases or liquids are compressed, expanded, heated, or cooled within an essentially closed system to produce a desired temperature result in the selected environment, An expandable-compressible refrigerant is contained and cycled within an essentially enclosed system comprised of various refrigerant manipulating components. When a liquid refrigerant expands (within a heat exchanger or evaporator) to produce a gas it increases its heat content at the expense of a first surrounding environment which decreases in temperature. The heat rich refrigerant is transported to a second surrounding environment and the heat content of the expanded refrigerant released to the second surroundings via condensation (within a heat exchanger or condenser), thereby increasing the temperature of the second surrounding environment. As indicated, even though the subject invention is used preferably with a refrigeration system, adaptation to a generalized heat pump system is also contemplated. Therefore, for a heat pump, heating or cooling conditions are generated in the first and second environments by reversing the process within the enclosed system.

The four basic components in all systems are: a compressor, a condenser, an evaporator, an expansion valve, and the necessary plumbing to connect the components. Gaseous refrigerant is compressed by the compressor and transported to the condenser which causes the gaseous refrigerant to liquefy The liquid refrigerant s transported to the expansion valve and permitted to expand gradually into the evaporator. After evaporating into its gaseous thrill, the gaseous refrigerant is moved to the compressor to repeat the cycle.

During compression the refrigerant gas pressure increases and also the refrigerant gas temperature increases. When the gas temperature/pressure of the compressor is greater than that of the condenser, gas will move from the compressor to the condenser. The amount of compression necessary to move the refrigerant gas through the compressor is called the compression ratio. A lower compression ratio reflects a higher system efficiency and consumes less energy during operation. The higher the gas temperature/pressure on the condenser side of the compressor, the greater the compression ratio. Greater the compression ratio, higher the energy consumption. Further, the energy (KW) necessary to operate a cooling or heat exchange system is primarily determined by three factors: the compressor's compression ratio; the refrigerant's condensing temperature; and the refrigerant's flow characteristics.

The compression ratio is determined by dividing the discharge pressure (head) by the suction pressure. Any change in either suction or discharge pressure will change the compression ratio.

It is noted that for refrigeration systems or any heat pump systems when pressure calculations are performed they are often made employing absolute pressure units (PSIA), however, since most individuals skilled in the art of heat pump technologies are more familiar with gauge pressure (PSIG), gauge pressures are used as the primary pressure units in the following exemplary calculations. In a traditional refrigeration system, a typical discharge pressure is 226 PSIG (241 PSIA) and a typical suction pressure is 68 PSIG (83 PSIA). Dividing 226 PSIG by 68 PSIG yields a compression ratio of about 2.9.

The condensing temperature is the temperature at which the refrigerant gas will condense to a liquid, at a given pressure. Well known standard tables relate this data. In a traditional example, using R22 refrigerant, that pressure is 226 PSIG. This produces a condensing temperature of 110 degrees F. At 110 degrees F., each pound of liquid freon that passes into the evaporator will absorb 70.05 Btu's. However, at 90 degrees F. each pound of freon will absorb 75.461 Btu's. Thus, the lower the temperature of the liquid refrigerant entering: the evaporator the greater its ability to absorb heat. Each degree that the liquid refrigerant, is lowered increases the capacity of the system by about one-half percent.

Well known standard tables of data that relate the temperature of a liquid refrigerant to the power required to move Btu's per hour show that if the liquid refrigerant is at 120 degrees F., 0.98 hp will move 22873 Btu's per hour. If the liquid refrigerant is cooled to 60 degrees F., only 0.2 hp is required to move 29563 Btu's per hour.

FIG. 1 shows the atomizing device (or apparatus) in accordance with an embodiment of the present invention. The device comprises two copper pipes 25 and 35, an atomizer 40 and a connector pipe 10. In one embodiment, the atomizer is a circular disc with at least two vertical blades 45. The blades are at an angle to the disc so as to provide the turbulence necessary for the refrigerant to vaporize. The disc is positioned inside the connector pipe 10 as shown, with the blades in contact with the inner surface 15 of the pipe 10. Preferably, the upper ends of the copper tubes have a smaller diameter, 20 and 30 as shown in the FIG. 1. The copper pipes are then inserted into the two open ends 12 of the connector pipe so that the their outer surfaces, 50 and 60 are in contact with the disc and hold it firmly in place.

According to an embodiment of the invention, the apparatus is positioned between the expansion valve and the evaporator coils of a heat exchange system (e.g., refrigeration or heat pump devices). The refrigerant entering the apparatus from the expansion valve is then focused in a spiral manner between the interior surface of the copper pipe and the disc. The blades are at angle to create and maintain spiral turbulent flow as the refrigerant vapor flows through the atomizer disc in the pipe. This develops a vortex that continues through the coil,ensuring uniform flow through the coil thereby improving heat transfer efficiency by reducing refrigerant pooling.

Figure 2:
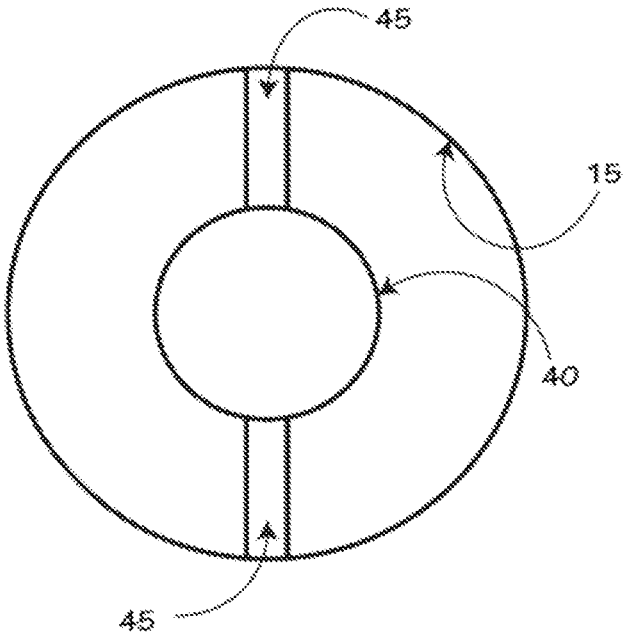
FIG. 2 is a cross section of the pipe with the disc.

FIG. 2 shows a cross section of the pipe with the disc 40 and two blades 45 which touch the interior surface of the connector pipe. In another aspect of the invention the number of blades may be increased in order to provide the turbulence to the the refrigerant flowing against the disc.

Figure 3:
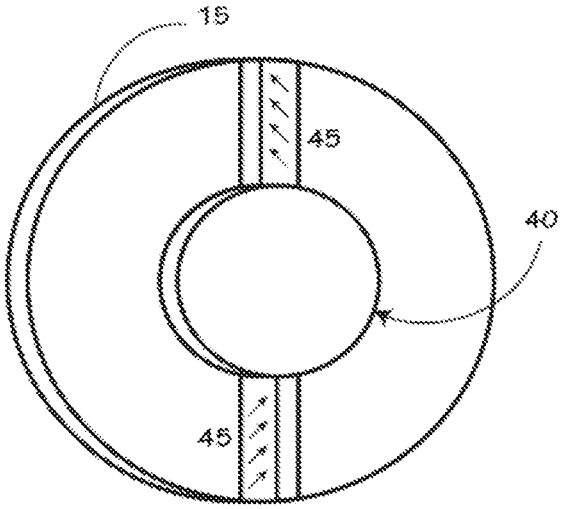
FIG. 3 is an isometric view of the disc in a slice of pipe.

FIG. 3 is an isometric view of the atomizer disc. The blades are at angle to the disc as shown by arrows. In some implementations of the invention, the width of the blades, the height and/or the angle may be varied. Other implementations include variations in atomizer disc size, copper pipe size and/or the ratio of atomizer disc diameter to copper pipe diameter.

Figure 4:
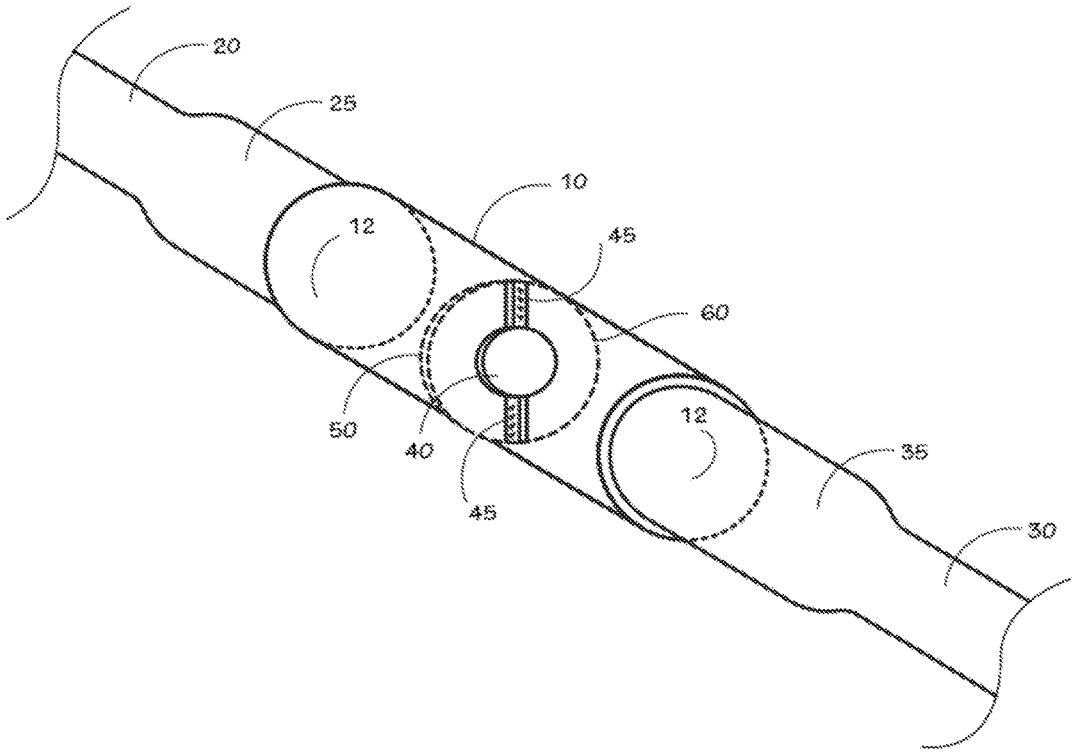
FIG. 4 shows the atomizing device with the disc positioned inside the connector pipe and the two copper pipes inserted into the connector to hold the disc in place.

FIG. 4 is a view of the apparatus comprising the atomizer disc placed inside a copper connector pipe where it is held together inside by two copper pipes compressed together. The two copper pipes are inserted through the two open ends, 12 of the connector pipe. The outer open ends of the two copper pipes 50 and 60 are in contact with the disc. The diameters 50 and 60 of the copper pipes are slightly smaller than the the outer connector pipe so that they touch the inner surface 15 of the outer pipe 10.

Figure 5:
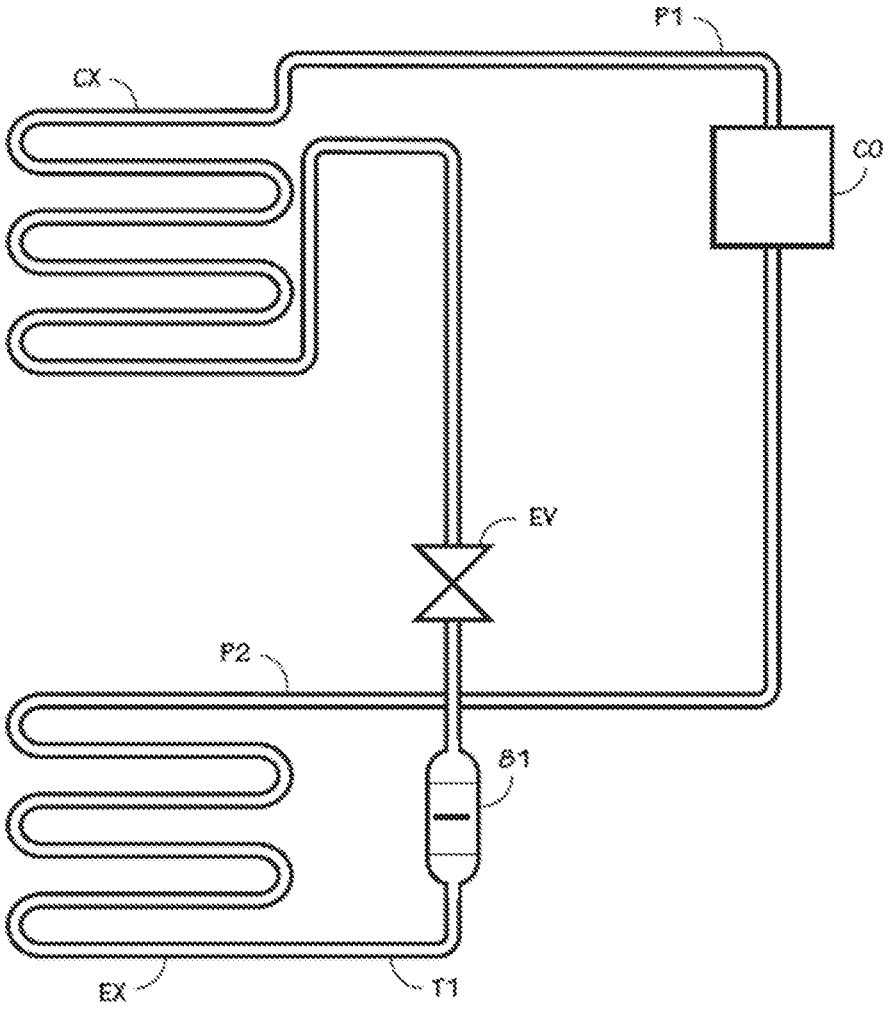
FIG. 5 shows the heat exchange system in accordance with an embodiment of the invention with the atomizing device positioned between the expansion valve and the evaporator.

The high pressure refrigerant flowing from the condenser and into the expansion valve is a mixture of liquid and vapor. At the valve, the refrigerant experiences a drop in pressure and then flows into the apparatus and against the disc. The angled configuration of the blades provides the necessary spiral turbulent motion for the refrigerant flowing through the pipes. The flow area of the refrigerant is therefore between the interior surface of the pipe and the disc. Here the refrigerator flows against the disc creating low pressure at the back of the disc thereby creating further vaporization of the un-vaporized liquid refrigerant. The two vertical blades are at angle to create and maintain the spiral turbulent flow as the refrigerant vapor flows through the atomizer disc in the pipe, A refrigeration/heat exchange system in accordance with an embodiment of the invention is shown in FIG. 5. Components of the system include compressor CO, condenser CX, evaporator EX and expansion valve EV The inventive apparatus, 81 is positioned between the expansion valve and the evaporator of the heat exchange system. The system efficiency of about 8-15% is achieved.

The efficiency of the system may further be enhanced to more than 20%, by introducing a sub cooling device or an auxiliary passive condenser between the condenser and the expansion valve (EV), details of which are discussed below with reference to FIGS. 6 and 7.

Figure 6:
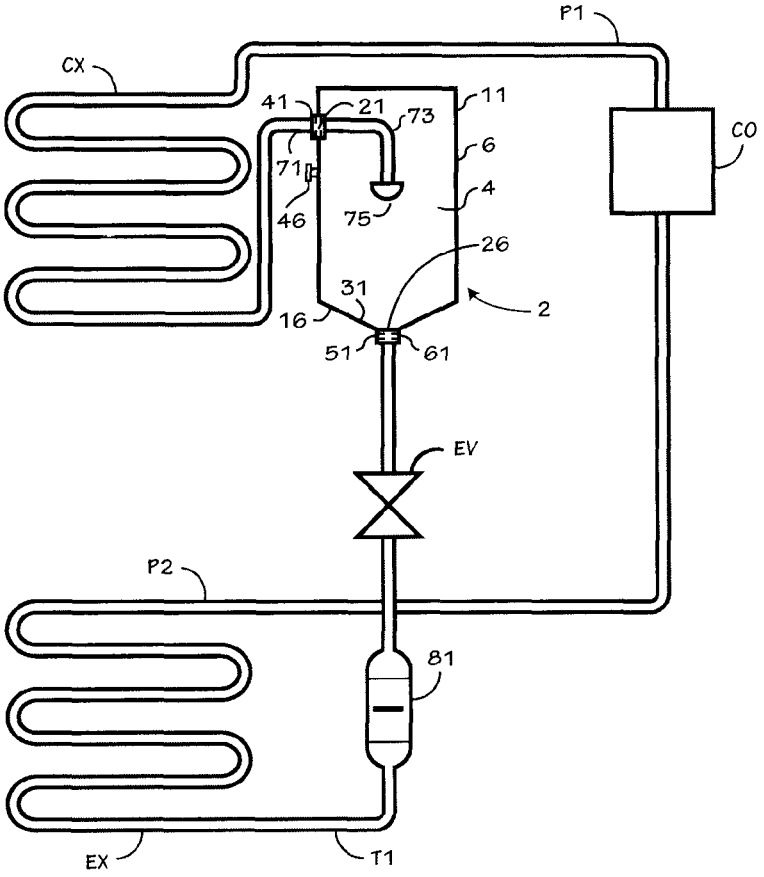
FIG. 6 shows the heat exchange system in accordance with an embodiment of the invention with the atomizing device and a sub cooling vessel between the condenser and evaporator.

Referring now to FIG. 6, there is shown a schematic view of a refrigeration system which includes a sub cooling device fitted into the system between the condenser CX and the evaporator EX. The system stores excess liquid refrigerant (that is normally stored in the condenser) in a holding: vessel 2, thus giving an increased condensing volume (usually approximately 20% more condensing volume), thereby cooling the refrigerant more (a type of sub-cooling). By adding this extra cooling, the system reduces the discharge pressure and suction pressure. For discharge at P1 the pressure is 168 PSIG (183 PSIA) and for suction at P2 the pressure is 60 PSIG (74 PSIA). With these discharge and suction pressures, the compression ratio calculates to be 2.5. For the traditional refrigeration system, the previously calculated compression ratio was 2.9. This shows a reduction in compression work of about 17%.

A liquid refrigerant entrance 21 and a liquid refrigerant exit 26 penetrate the vessel 2. Preferably,the refrigerant entrance 21 is located in a top region of the vessel 2. The top region is defined as being approximately between a midline of the cylinder 6, bisecting the cylinder 6 into two smaller cylinders, and the top end cap 11. Although FIG. 6 depicts the refrigerant entrance 21 as penetrating the cylinder 6, the entrance may penetrate the top end cap 11. Preferably, the refrigerant exit 26 is located in a bottom region of the vessel 2. The bottom region of the vessel 2 is defined as being approximately between the midline, above, and the bottom end cap 16. Although other locations are possible, the refrigerant exit 26 is preferably located proximate the center of the bottom end cap 16.

Usually, the bottom end cap 16 has an angled or sloping interior surface 31. However, the bottom end cap 16 may have an interior surface of other suitable configurations, including being flat.

Liquid refrigerant liquefied by the condenser CX enters into the vessel 2 via the refrigerant entrance 21 and the associated components. The associated entrance components comprise a refrigerant delivery tube comprising an entrance fitting 41 that secures the vessel 2 into the exit portion of the plumbing coming from the condenser CX. The entrance fitting 41 is any suitable means that couples the subject device into the plumbing in the required position between the condenser CX and the evaporator EX.

To view the level of the liquid refrigerant within the vessel a sight glass 46 is provided. The glass 46 is mounted in the cylinder 6 at a suitable position to note the refrigerant level.

The refrigerant exit 26 is comprised of an exit tube and fitting 51 that secures the subject device into the plumbing of the system. The exit fitting 51 is any suitable means that couples the subject device into the plumbing in the required position between the condenser CX and the evaporator EX.

A second means for introducing a turbulent flow into the exiting liquefied refrigerant is mounted proximate the exit 26. A "turbulator" 61 is held in place by cooperation between the exit tube and fitting 51 or any other equivalent means. The turbulator is usually a separate component that is secured within the components of the exit from the vessel 2, however, the turbulator may be an integral part of the vessel 2 refrigerant exit. The turbulator comprises a disk with a central aperture and at least one fixed angle blade formed or cut into the disk. Preferably, a set of fixed angle blades are provided to add turbulence to the exiting refrigerant.

The blades are angled to induce rotational, turbulent motion of the liquid refrigerant as the refrigerant exits the vessel 2. Various angles for the blades are suitable for generating the required turbulence.

Preferably, the subject vessel 2 is placed in the adapted system so that the refrigerant exit 26 is no lower than the lowest portion of the condenser CX.

A disk 71 positioned at the liquid refrigerant entrance 21 may include an aperture connected to a bypass tube 73 extending into the center of the vessel, which terminates in at least one bypass exit port 75 thereby reintroducing the bypass refrigerant to the rest of the refrigerant stream at the bottom of the vessel.

Liquid refrigerant from the condenser CX enters the vessel 2 and is directed into a swirling motion about the interior volume 4. The swirling liquid refrigerant leaves the vessel 2 by means of the refrigerant exit 26 and then encounters the turbulator 61. The blades of the turbulator 61 add additional turbulence into the flow of the refrigerant.

After the refrigerant enters the vessel and starts to exit, it develops a shallow-well vortex at the bottom of the vessel 2. In the center of the shallow-well vortex, it develops a low-pressure area. The stronger the vortex, which increases as it becomes hotter, the greater the low-pressure area in the center of the vortex, thereby being able to sub-cool the refrigerant.

With the development of the low-pressure area in the center of the vortex, the small amount of refrigerant entering the bypass path at the liquid refrigerant entrance 21 expands and comes out at the bypass path exit port 75 to sub-cool the refrigerant and allow the heat bubbles carried by the refrigerant to continue to condense so as to allow the refrigerant that is delivered downstream to the expansion valve to have less non-condensed refrigerant within hereby improving the operation of the system.

In a preferred embodiment, the disk 71 positioned at the liquid refrigerant entrance 21 comprises an incremental expansion device disk. The disk develops a low pressure area on the back side and creates a turbulent flow of refrigerant entering the vessel, thereby improving refrigerant efficiency. The disk may be such as was disclosed above as turbulator 61 at the refrigerant exit; or disclosed in the heat pump efficiency enhancer of U.S. Pat. No. 5,259,213 (e.g., FIG. 4, valve plate 160 of that disclosure); or any other disk configuration that develops a low pressure area on the back side and creates a turbulent flow of refrigerant, which can be incorporated into the refrigerant entrance 21 of the vessel.

Figure 7:
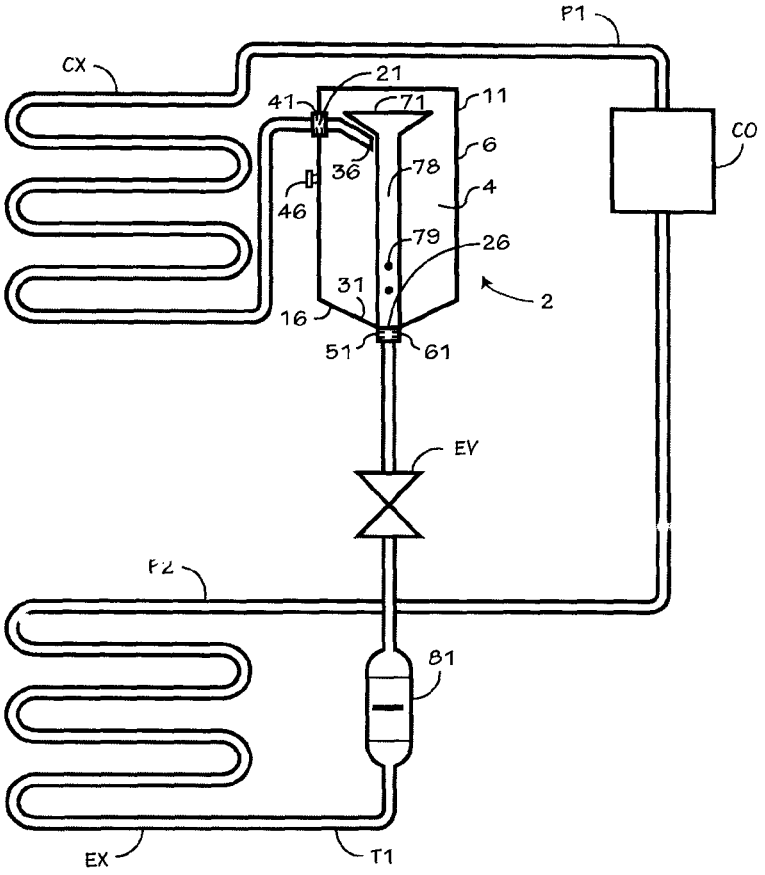
FIG. 7 shows the heat exchange system in accordance with an embodiment of the invention with the atomizing device and an auxiliary passive condenser between the condenser and evaporator.

Referring now to FIG. 7, there is shown a schematic view of a refrigeration system which includes an auxiliary passive condenser fitted into the system between the condenser CX and the evaporator EX and before the expansion valve. This helps to condense and thereby sub-cool a portion of the refrigerant within the chamber 2. The auxiliary passive condenser is preferably fabricated from a cylinder 6 and top 11 and bottom 16 end caps of suitable material such as a metal, metal alloy, or natural or synthetic polymers. Generally, the top 11 and bottom 16 end caps are secured to the cylinder 6 by appropriate means such as soldering, welding, brazing, gluing, threading and the like, however, the entire chamber may be formed from a single unit with the cylinder 6 and top 11 and bottom 16 end caps as a unitized construction.

A liquid refrigerant entrance 21 and a liquid refrigerant exit 26 penetrate the passive condenser. Preferably, the refrigerant entrance 21 is located in a top region of the chamber 2. The top region is defined as being approximately between a midline of the cylinder 5, bisecting the cylinder 6 into two smaller cylinders, and the top end cap 11. Preferably, the refrigerant exit 26 is located in a bottom region of the chamber 1. The bottom region of the chamber 2 is defined as being approximately between the midline, above, and the bottom end cap 16. Although other locations are possible, the refrigerant exit 26 is preferably located proximate the center of the bottom end cap 16. The bottom end cap 16 has an angled or sloping interior surface 31. However, the bottom end cap 16 may have an interior surface of other suitable configurations, including being flat.

Liquid refrigerant liquefied by the condenser CX enters into the chamber 2 via the refrigerant entrance 21 and the associated components. The associated entrance components comprise an entrance fitting 41 that secures the chamber 2 into the exit portion of the plumbing coming from the condenser CX. The entrance fitting 41 is any suitable means that couples the subject device into the plumbing in the required position between the condenser CX and the evaporator EX.

To view the level of the liquid refrigerant within the chamber 2, a sight glass 46 is provided. The glass 46 is mounted in the cylinder 6 at a suitable position to note the refrigerant level.

In the center of the passive condenser is a down tube with an inlet 71 at the top surface and an outlet at the bottom that passes through the exit fitting, 51. Preferably, the inlet 71 has a width that is greater than the rest of the tube so that the tube is almost shaped like a funnel. According to an embodiment of the invention, the inlet is sealed with a vapor tube expansion screen such as a mesh/sieve. Preferably, the mesh size varies between 11 microns to 51 microns and is made from copper, aluminum or any alloy containing copper. However, depending on the thickness of the down tube, the mesh size can vary beyond this range. Liquid refrigerant from the condenser CX enters the auxiliary passive condenser and flows to the bottom of the unit, filling up to almost one-third of the volume of the unit. At least three holes 79, are located in the lower portion of the down tube. Preferably the holes are positioned in the lower region within about one fourth the height of the cylinder. The condensed liquid refrigerant that flows into the passive condenser, passes through the holes and into the down tube. The size of the holes are designed so that almost half the length of the down tube is filled with the refrigerant liquid before draining at the bottom 60, thereby creating a vortex to the exit, and around the down tube.

The suction of the refrigerant through the holes 79 at the bottom of the down tube creates a vacuum inside the tube. As a result, the non-condensed refrigerant is drawn towards the top inlet 71 past the vapor tube expansion screen, raising the non-condensed refrigerant up further and allowing for further cooling within the chamber. When the refrigerant eventually exits the passive condenser, it is considerable cooler than when it entered the vessel, making the entire refrigeration system more efficient. This cooling state can be greatly improved with a vortex flow as well as increasing the inlet and outlet line size, to coincide with the size of the refrigeration unit.

Preferably the auxiliary passive condenser is placed in the adapted system so that the refrigerant exit 26 is no lower than the lowest portion of the condenser CX. The refrigerant exit 26 is comprised of an exit tube and fitting 51 that secures the subject device into the plumbing of the system. The exit fitting 51 is any suitable means that couples the subject device into the plumbing in the required position between the condenser CX and the evaporator EX.

In some implementations of the invention, the return line which is the down tube may be enlarged in order to get more suction,. Other implementations include increasing the ratio of size of the inlet to the size of the outlet pipe to enhance the refrigerant flow. This gives more low pressure as needed for adequate cooling of the refrigerant within the secondary condenser or supplementary (auxiliary) passive condenser.

With the development of the low pressure area, the small amount of refrigerant entering the holes at the lower end of the down tube creates a vacuum and allows the heat bubbles carried by the refrigerant to continue to condense so as to allow the refrigerant that is delivered downstream to the expansion valve to have less non-condensed refrigerant.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

I claim:

1. An apparatus for enhancing the efficiency of a heat exchange system having a compressor, condenser, evaporator, an expansion valve and a circulating refrigerant, said apparatus comprising:

a) a tubular device having a refrigerant entrance and a refrigerant exit, said device positioned in the heat exchange system between the expansion valve and the evaporator;

b) means associated with said device for atomizing said refrigerant flowing into the device from the expansion valve wherein said atomizing means comprises a disc shaped plate comprising at least two blades positioned on the circumference of the disc, and further said at least two blades are at an angle to the disc and touch the interior of the outer pipe.

2. The apparatus of claim 1, wherein said tubular device comprises an outer pipe having a first open end and a second open end, with the atomizing means positioned inside said outer pipe.

3. The apparatus of claim 2, wherein said tubular device further comprises:

a first inner pipe passing through the first open end of said outer pipe; and a second inner pipe passing through the second open end of said outer pipe;

wherein the first inner pipe and the second inner pipe are in contact with the atomizing means.

4. A heat exchange system having a compressor, condenser, evaporator, an expansion valve, a circulating refrigerant and an efficiency enhancing apparatus positioned between the expansion valve and the evaporator, said apparatus comprising:

a) a tubular device having a refrigerant entrance and a refrigerant exit and b) means for atomizing said refrigerant wherein said atomizing means causes a portion of the liquid refrigerant to evaporate; wherein said atomizing means is a disc shaped plate comprising at least two blades positioned on the circumference of the disc and further, said at least two blades are at an angle to the disc and touch the interior of said outer pipe.

5. The heat exchange system of claim 4, wherein said device comprises an outer pipe having a first open end and a second open end, an atomizing means positioned inside said outer pipe; a first inner pipe passing through the first open end of said outer pipe; and a second inner pipe passing through the second open end of said outer pipe; wherein the first inner pipe and the second inner pipe are in contact with the atomizing means.

6. A method of improving the efficiency of a heat exchange system comprising a compressor, condenser, an expansion valve, evaporator and a circulating refrigerant, said method comprising the steps of:

compressing the refrigerant in said compressor;

passing said refrigerant through the condenser;

allowing the refrigerant exiting said condenser to flow through the expansion valve and into a tubular device;

wherein said tubular device comprises a means for atomizing said refrigerant flowing into the apparatus from the expansion valve, wherein said atomizing means causes a portion of the liquid refrigerant to evaporate and comprises a disc shaped plate comprising at least two blades positioned on the circumference of the disc and further, said at least two blades are at an angle to the disc and touch the interior of said outer pipe.

7. The method of claim 6, wherein said tubular device comprises an outer pipe having a first open end and a second open end, an atomizing means positioned inside said outer pipe; a first inner pipe passing through the first open end of said outer pipe; and a second inner pipe passing through the second open end of said outer pipe; wherein the first inner pipe and the second inner pipe are in contact with the atomizing means.

8. An apparatus for enhancing the efficiency of a heat: exchange system having a compressor, condenser, evaporator, an expansion valve and a circulating refrigerant, said apparatus comprising:

a tubular device having a refrigerant entrance and a refrigerant exit, said device positioned in the heat exchange system between the expansion valve and the evaporator;

b) means associated with said device for atomizing the refrigerant flowing into the device from the expansion valve wherein said atomizing means causes a portion of the liquid refrigerant to evaporate, said means comprising:

disc shaped plate comprising, at least two blades positioned on the circumference of the disc.

9. An apparatus for enhancing the efficiency of a heat exchange system having a compressor, condenser, evaporator, an expansion valve and a circulating refrigerant, said apparatus comprising:

a) a tubular device having a refrigerant entrance and a refrigerant exit, said device positioned in the heat exchange system between the expansion valve and the evaporator; wherein said tubular device comprises:

(i) an outer pipe having a first open end and a second open end;

(ii) a first inner pipe passing through the first open end of said outer pipe; and a second inner pipe passing through the second open end of said outer pipe;

b) means associated with said device for atomizing the refrigerant flowing into the device from the expansion valve wherein said atomizing means causes a portion of the liquid refrigerant to evaporate and comprises a disc shaped plate comprising at least two blades positioned on the circumference of the disc.

10. An apparatus for enhancing the efficiency of a heat exchange system having a compressor, condenser, evaporator, an expansion valve and a circulating refrigerant, said apparatus comprising:

a) a tubular device having a refrigerant entrance and a refrigerant exit, said device positioned in the heat exchange system between the expansion valve and the evaporator; wherein said tubular device comprises:

(i) an outer pipe having a first open end and a second open end;

(ii) a first inner pipe passing through the first open end of said outer pipe; and a second inner pipe passing through the second open end of said outer pipe;

b) means associated with said device for atomizing the refrigerant flowing into the device from the expansion valve wherein said atomizing means causes a portion of the liquid refrigerant to evaporate, said means comprising:

disc shaped plate comprising at least two blades positioned on the circumference of the disc, wherein said at least two blades are at an angle to the disc touch the interior of said outer pipe.

* * * * *